United States Patent [19]

Marsh

[11] 4,197,803

[45] Apr. 15, 1980

[54] VISUAL AID IMPROVEMENT TO A PRESSER DEVICE FOR SEWING BUTTONHOLES

[75] Inventor: Walter H. W. Marsh, Fanwood, N.J.

[73] Assignee: The Singer Company, New York, N.Y.

[21] Appl. No.: 34,795

[22] Filed: Apr. 30, 1979

[51] Int. Cl.[2] ..... D05B 3/24

[52] U.S. Cl. ..... 112/77; 112/235

[58] Field of Search ..... 112/235, 75, 115, 77, 112/70, 73, 76, 158 B

[56] References Cited

U.S. PATENT DOCUMENTS

| | | | |
|---|---|---|---|
| 3,113,537 | 12/1963 | Bono . | |
| 3,137,254 | 6/1964 | Enos et al. | 112/115 X |
| 3,656,443 | 4/1972 | Ross | 112/235 X |
| 3,835,798 | 9/1974 | Fresard et al. . | |
| 3,877,403 | 4/1975 | Ketterer | 112/77 |
| 3,949,687 | 4/1976 | Julien . | |
| 4,091,752 | 5/1978 | Odermann | 112/77 |

FOREIGN PATENT DOCUMENTS

| | | |
|---|---|---|
| 201410 | 6/1978 | Austria . |
| 38-27866 | 12/1963 | Japan . |
| 47-13396 | 5/1972 | Japan . |
| 51-53944 | 5/1976 | Japan . |
| 51-161956 | 12/1976 | Japan . |
| 52-138950 | 10/1977 | Japan . |

*Primary Examiner*—Henry Jaudon
*Assistant Examiner*—Andrew M. Falik
*Attorney, Agent, or Firm*—Robert E. Smith; Edward L. Bell; William V. Ebs

[57] ABSTRACT

An improved visual aid mechanism for a presser device for facilitating the making of buttonholes. The mechanism will sense and indicate to the operator the approaching end of the first leg of a buttonhole being sewn whose length has been preset by the operator. This invention utilizes flexible fingers which are substantially deflected by an adjustable stop member to provide a magnified visual indication. Thus the operator may stop the sewing operation very precisely resulting in buttonholes of consistently uniform length and quality.

4 Claims, 4 Drawing Figures

VISUAL AID IMPROVEMENT TO A PRESSER DEVICE FOR SEWING BUTTONHOLES

BACKGROUND OF THE INVENTION

Sewing machine presser devices for facilitating the making of buttonholes are well known. Such devices commonly have a work engaging shoe that is adapted to slide with respect to a presser foot in a direction coincident to the direction of feed of the underbed work feeding mechanism of the sewing machine. With this construction the work feeding mechanism, by contacting the work fabric, advances the work engaging shoe relative to the presser foot. There may be indicia marks on the shoe or an adjustable gauging member to aid the operator in visually gauging the length of the buttonhole. Other devices utilize an adjustable stop member to provide a physical barrier against further movement when the advancing shoe engages the presser foot, or an adjustable stop member to trip a mechanical or electric switch for automatically reversing the direction of feed and sewing the second half of the buttonhole. A presser device for sewing buttonholes that utilizes the visual gauging technique for determining the end of the buttonhole is disclosed in U.S. Pat. No. 3,137,254 dated June 16, 1964 of J. P. Enos et al. The Enos device utilizes an adjustable pointer located behind the sewing needle which can be set to a distance representing the desired buttonhole length. The operator will sew until the bar tack at the top of the first leg of the buttonhole is aligned with the adjustable pointer thus establishing the desired buttonhole length. However, because this method requires visual alignment of a stationary pointer and a moving bar tack, it is difficult to achieve consistent buttonhole lengths. There are many existing devices that use the barrier technique for determining the end of the buttonhole. The present invention is primarily addressed to this type of presser device. Such devices typically include an adjustable stop member that may be manually set to the desired buttonhole length and locked in place. A representative example of such devices is disclosed in Japanese Lay-Open No. 51-53944 dated May 12, 1976 by Kumao Niino et al. Niino utilizes a presser foot having a work engaging shoe adapted to slide relative thereto and an adjustable stop member that may be manually positioned by inserting an appropriately sized gauging button into a receiving area of the device and manually adjusting the stop member until it engages the button. The stop member is then locked in place. With this type of device the operator must be attentive as the advancing shoe carries the stop member toward the presser foot, and be ready to stop or reverse the feed at the exact instant of contact between the stop member and the presser foot. Any delay in doing this may result in twisting or irregular feeding of the material under the now stationary work engaging shoe or, if the work remains stationary along with the work engaging shoe the needle will continue to cycle and create a build up of thread stitches at the end of the buttonhole. In either case, an irregular and unattractive buttonhole is produced.

SUMMARY OF THE INVENTION

The present invention overcomes these difficulties of the prior art by providing a positively displaced visual indicator mechanism to sense and indicate to the operator the approaching end of the first leg of a buttonhole being sewn whose length has been preset. Additionally there is a buffer distance provided within which the operator may stop or reverse the direction of feed of the machine that eliminates the twisting or irregular feeding of work fabric at the end of the buttonhole as well as build up of thread stitches there. This is accomplished through the use of flexible fingers associated with an adjustable stop member which is manually positioned to provide a desired buttonhole length. The work engaging shoe and associated adjustable stop member advance as one leg of the buttonhole is being sewn. At the instant the desired length is reached, the flexible fingers associated with the advancing adjustable stop member engage the presser foot and are thereby deflected a substantial amount to provide an exaggerated visual indication to the operator. The distance traveled by the work from the point the presser foot first engages the flexible fingers to the point where the flexible fingers are fully deflected provides a sufficient buffer distance within which the operator may reverse the feed or stop the machine. Thus the operator may stop the sewing operation very precisely resulting in buttonholes of consistently uniform length and quality.

It is therefore an objective of this invention to provide a buttonhole facilitating presser device having an improved indicator for permitting the operator to visually determine the end of a buttonhole being sewn both easily and consistently accurately.

It is a further objective of this invention to provide a novel visual indicator that reliably and precisely indicates contact between the presser foot and adjustable stop member of the presser device for facilitating the making of buttonholes.

According to the present invention, there is provided in a sewing machine, buttonhole stitching instrumentalities, an underbed work feed mechanism including a work engaging bar for transporting work fabric in a predetermined direction, a presser foot arranged in opposition to the work engaging bar, and a work engaging shoe member with means slidably supporting the shoe member for movement relative to the presser foot in a direction coincident to the predetermined direction of feed of the underbed work feed mechanism. There is an adjustable stop member with means for selectively locating the stop member on the shoe member at a predetermined distance from the presser foot for setting the length of the buttonhole desired. Upon reaching the end of the first leg of the buttonhole being sewn the presser foot will come into abutting contact with the adjustable stop member. The improvement comprises a flexible finger having a free extremity and means at the opposite extremity rigidly attaching the flexible finger to the adjustable stop member. The presser foot has on its end a protrusion such that when the work engaging bar advances the work and thereby advances the shoe member sufficiently, the protrusion will engage the flexible finger and deflect it a substantial amount for providing a visual indication that the end of the first leg of the buttonhole being sewn has been reached.

DESCRIPTION OF THE DRAWINGS

The invention, both as to its construction and to its method of operation, together with additional objects and advantages thereof, will be best understood upon reading the following detailed description of the invention with reference to the accompanying drawings, in which.

PREFERRED EMBODIMENT OF THE INVENTION

Figure 1:
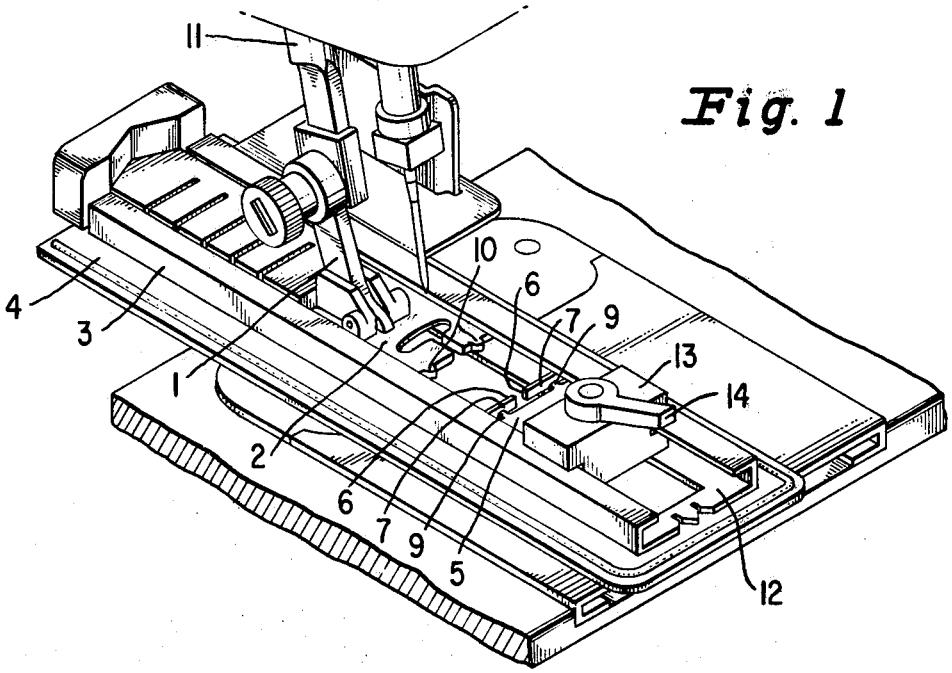
FIG. 1 is a perspective view of a typical presser device for facilitating the making of buttonholes showing the improved visual indicator device of this invention.

Referring to FIGS. 1, 2, 3 and 4, there is shown a typical presser device, for facilitating the making of buttonholes, having a shank 1 attachable at one end to a presser foot bar 11 of a sewing machine and at the other end pivotally supporting a presser foot 2. A work engaging shoe 3 having a U-shaped cross section 12 for sliding engagement with the presser foot 2 and operationally supported thereon such that the shoe 3 is free to slide in the direction of work feed, and a work engaging plate 4 cooperating with the work engaging shoe 3 for firmly holding the work and aiding in its uniform advancement during the buttonhole sewing operation. For a detailed description of the construction and interrelationship of the presser foot shank 1, presser foot 2, work engaging shoe 3 and work engaging plate 4 see U.S. Pat. No. 3,877,403 dated Apr. 15, 1975 by Ketterer, the disclosure of which is incorporated herein by reference. A presser foot adjustable stop member 5 is slidably supported in the U-shaped cross section 12 of the work engaging shoe 3 and has a retaining member 13 and a locking lever 14, for locking stop member 5 into a position representing the desired buttonhole length, said structure being more fully described in Austrian Pat. No. 201,410 dated June 15, 1958 by Anker-Werke. Two flexible fingers 7 are provided, one end of each being mounted to the side of stop member 5 which is closest to presser foot 2, the junction point 8 of said mounting being at either extremity of stop member 5 such that the two fingers 7 are aligned normal to the direction of work feed and their tips 6 are mutually adjacent and in substantial mutual alignment while the fingers 7 are in their free state and not being deflected by an outside influence.

Two limit projections 9 project from the stop member 5 such that a force, operating in a direction opposite the direction of feed, acting on the flexible fingers 7 will cause the fingers 7 to deflect toward stop member 5 until they contact the projections 9 at which point tips 6 of fingers 7, while having deflected substantially, will be prevented from contacting surface 15 of stop member 5 by virtue of the limit projections 9. Further, the total allowable movement of the fingers 7 due to the deflecting force must be within their elastic limit so that when the force is removed they will return to their original aligned positions. Two protrusions 10 are located on the side of presser foot 2 nearest to stop member 5 and in substantial alignment with the two limit projections 9.

Figure 2:
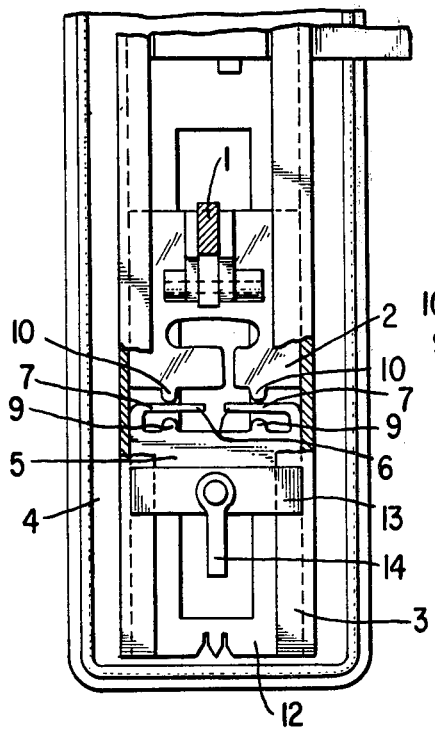
FIG. 2 is a partial top view of the presser device of FIG. 1 showing the adjustable stop member just prior to contact with the presser foot.
Figure 3:
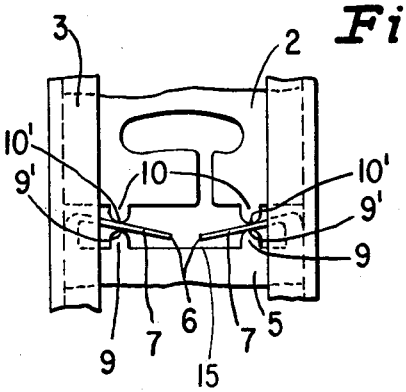
FIG. 3 is similar to FIG. 2 however the adjustable stop member is shown in contact with the presser foot.
Figure 4:
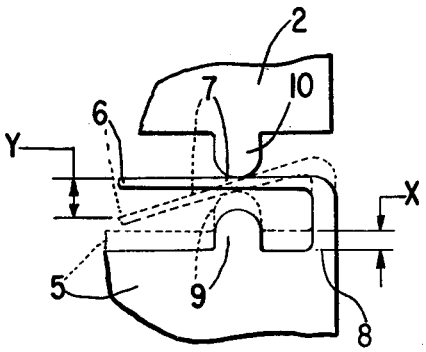
FIG. 4 illustrates the maximum deflection of a flexible finger in relation to the forward movement of the stop member.

In operation, while sewing the first leg of a buttonhole and approaching the end of the leg, the shoe 3, in sliding engagement with the presser foot 2, will move forward, being urged to do so by the work engaging bar of the underbed feed dog mechanism. The adjustable stop member 5, being locked in place relative to shoe 3 and moving along therewith, will approach presser foot 2 as shown in FIG. 2. As movement continues the protrusions 10 will operationally engage the flexible fingers 7, deflecting same until the deflecting fingers 7 contact the limit projections 9, as shown in FIG. 3, thereby preventing further forward movement of the shoe 3 relative to the presser foot 2. At this point the tips 6 of the flexible fingers 7 have deflected a maximum amount possible thereby providing a visual indication that the first leg of the buttonhole is complete. Referring to FIG. 4, it is desirable that the limit projections 9 and the protrusions 10 be positioned such that the distance (Y) the tips 6 move from their free state position to their fully deflected position is substantially larger than the distance (X) moved by the stop member 5 from the point first contact is made between the protrusions 10 and the fingers 7, as indicated by the solid lines in FIG. 4 to the point of maximum deflection of the fingers 7, as indicated by the broken lines in FIG. 4. It is further desirable that projections 9 and protrusions 10 be in mutual alignment such that when the flexible fingers 7 are in their fully deflected state, as shown in FIG. 3, there is substantially zero torque imparted to the fingers 7, about an axis that lies midway between the abutting surfaces 9' and 10'.

I claim:

1. A sewing machine having stitch forming instrumentalities, a buttonhole producing mechanism, an underbed work feed mechanism therein including a work engaging bar for transporting work fabric in a predetermined direction, a presser foot arranged in opposition to said work engaging bar, a work engaging shoe member, and means slidably supporting said shoe member for movement relative to said presser foot in a direction coincident to said predetermined direction of feed of said underbed work feed mechanism, an adjustable stop member, means for selectively locating said stop member on said shoe member at a predetermined distance from said presser foot such that said presser foot will come into abutting contact with said adjustable stop member upon reaching the end of the first leg of the buttonhole being sewn, wherein the improvement comprises:

a. a flexible finger having a free extremity and means at the opposite extremity rigidly attaching said flexible finger to said adjustable stop member; and b. a protrusion on said presser foot located such that when said underbed work feed mechanism advances the work and thereby advances said work engaging shoe member sufficiently said protrusion will engage said flexible finger and deflect same for providing a visual indication that the end of the first leg of the buttonhole being sewn has been reached.

2. An improved buttonhole presser device for use with a sewing machine having a buttonhole producing mechanism and underbed work feed mechanism therein, for transporting work fabric in a predetermined direction said buttonhole presser device having a presser foot, a work engaging shoe member, and means slidably supporting said shoe member for movement relatively to said presser foot in a direction coincident to said predetermined direction of feed of said underbed work feed mechanism, an adjustable stop member, means for selectively locating said stop member on said shoe member at a predetermined distance from said presser foot for indicating the length of the buttonhole to be sewn, whereby said presser foot will come into abutting contact with said adjustable stop member upon reaching the end of the first leg of the buttonhole being sewn, wherein the improvement comprises:

a. a flexible finger having a free extremity and means at the opposite extremity rigidly attaching said flexible finger to said adjustable stop member; and b. a protrusion on said presser foot located such that when said underbed work feed mechanism advances the work and thereby advances said work engaging shoe member sufficiently said protrusion will engage said flexible finger and deflect same for providing a visual indication that the end of the first leg of the buttonhole being sewn has been reached.

3. The buttonhole presser device as set forth in claim 2 wherein said flexible finger is aligned in a direction normal to said direction of feed, and said adjustable stop member has attached thereto a limit projection in substantial alignment with said protrusion such that said protrusion will deflect said flexible finger until said flexible finger contacts said limit projection thereby limiting said deflection and confining the movement of said flexible finger such that the elastic limit of said flexible finger is not exceeded.

4. The buttonhole presser device as set forth in claim 2 wherein said free extremity of said flexible finger has a first assumed position when said protrusion is not in engagement with said flexible finger and has a second assumed position when said stop member has, from a point of first contact between said protrusion and said flexible finger, advanced a minimal distance such that said protrusion has deflected said flexible finger, said protrusion being positioned relative to said flexible finger such that the distance from said first assumed position to said second assumed position is greater than said minimal distance advanced by said stop member, thereby providing an exaggerated visual indication to the operator.

* * * * *